US008468631B2

(12) United States Patent
Farid et al.

(10) Patent No.: US 8,468,631 B2
(45) Date of Patent: Jun. 25, 2013

(54) METHOD FOR CONTROLLING A LAUNDRY TREATING APPLIANCE BASED ON A FLOOR PARAMETER

(75) Inventors: Farshad Farid, Stevensville, MI (US); Dennis L. Kehl, Benton Harbor, MI (US); Kenneth P. Mitera, Livonia, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 424 days.

(21) Appl. No.: 12/891,846

(22) Filed: Sep. 28, 2010

(65) Prior Publication Data

US 2012/0073062 A1 Mar. 29, 2012

(51) Int. Cl.
*D06F 35/00* (2006.01)

(52) U.S. Cl.
USPC ..... 8/158; 8/159; 68/12.27; 68/23.1; 68/23.4

(58) Field of Classification Search
USPC ..... 8/158–159; 68/12.27, 23.1, 23.4
See application file for complete search history.

(56) References Cited

U.S. PATENT DOCUMENTS

| | | | | |
|---|---|---|---|---|
| 4,991,247 | A | 2/1991 | Castwall et al. | |
| 6,530,100 | B2 | 3/2003 | Conrath | |
| 7,676,874 | B2 * | 3/2010 | Cho | 8/158 |
| 2009/0241605 | A1 | 10/2009 | Moore | |
| 2010/0005598 | A1 | 1/2010 | Jung | |

FOREIGN PATENT DOCUMENTS

| | | | |
|---|---|---|---|
| WO | 2008/012032 | A1 | 1/2008 |
| WO | 2008/028566 | A1 | 3/2008 |

* cited by examiner

*Primary Examiner* — Michael Barr
*Assistant Examiner* — Jason Ko
(74) *Attorney, Agent, or Firm* — Clifton G. Green; McGarry Bair PC

(57) ABSTRACT

A method for controlling the operation of a laundry treating appliance resting on a floor and having a rotatable drum defining a treating chamber that includes creating an imbalance in the drum, rotating the drum at least one predetermined speed, determining an out of balance parameter, determining a floor parameter of the floor based on the out of balance parameter, and setting at least one operating parameter based on the floor parameter.

23 Claims, 6 Drawing Sheets

METHOD FOR CONTROLLING A LAUNDRY TREATING APPLIANCE BASED ON A FLOOR PARAMETER

BACKGROUND OF THE INVENTION

Laundry treating appliances, such as clothes washers, refreshers, and non-aqueous systems, may have a rotatable drum defining a treating chamber for treating laundry according to a cycle of operation. For some laundry treating appliances, vibration and noise may be generated from an imbalance in the drum created by unevenly distributed laundry inside the treating chamber. The floor on which the laundry treating appliance is positioned may also contribute to the vibration and noise generated during a cycle of operation.

Some laundry treating appliances may include a damping system, such as a suspension system or an active balancing system, to reduce vibration and noise generated from the laundry treating appliance during a cycle of operation. The damping system is usually optimized while the laundry treating appliance rests on a pre-selected floor type.

BRIEF DESCRIPTION OF THE INVENTION

A method for controlling the operation of a laundry treating appliance resting on a floor and having a rotatable drum defining a treating chamber comprises creating an imbalance in the drum, rotating the drum at least one predetermined speed, determining an out of balance parameter for an out of balance condition created by the rotation of the drum with the imbalance, determining a floor parameter of the floor based on the out of balance parameter, and setting at least one operating parameter based on the floor parameter.

DESCRIPTION OF AN EMBODIMENT OF THE INVENTION

Figure 1:
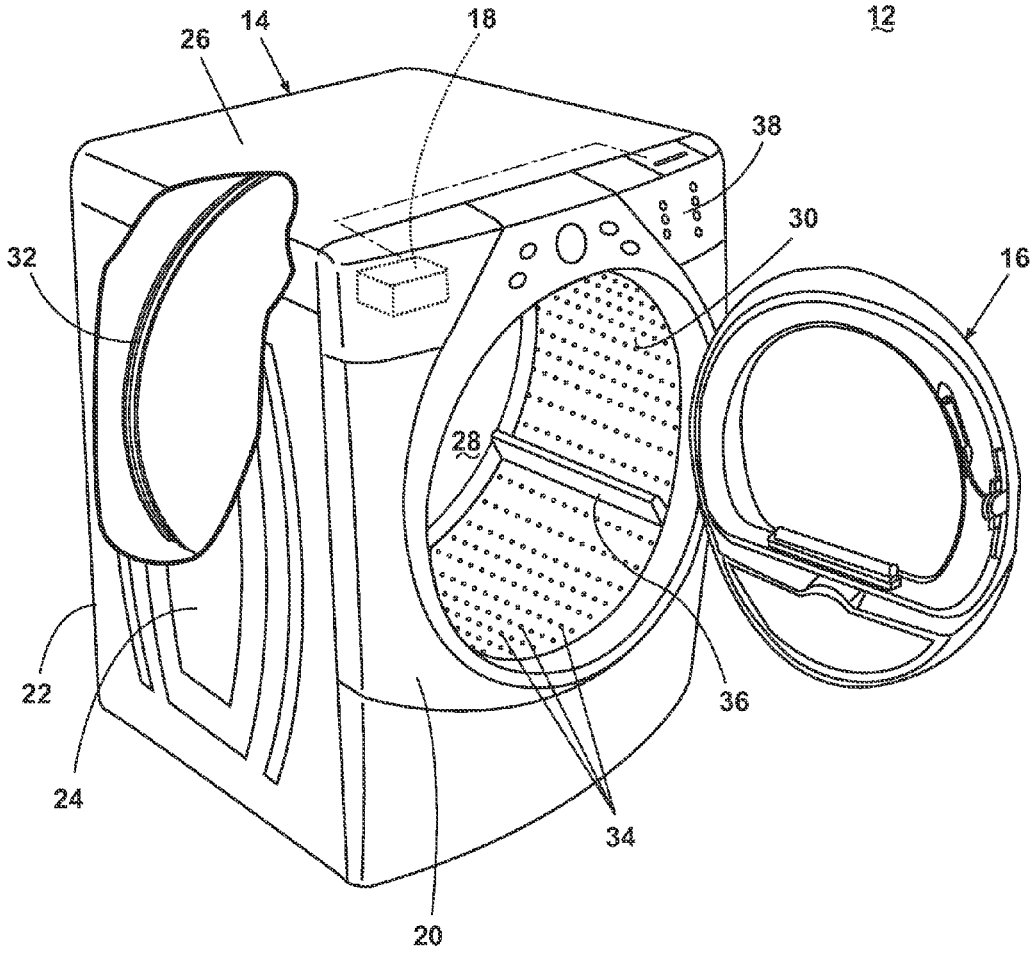
FIG. 1 is a schematic perspective view of a laundry treating appliance according to one embodiment of the invention.

FIG. 1 is a schematic perspective view of a laundry treating appliance 12 according to one embodiment of the invention. The methods described herein may be used with any suitable laundry treating appliance and are not limited to use with washing machines, including the laundry treating appliance 12 described below and shown in the drawings. As illustrated, the laundry treating appliance 12 may be a horizontal axis laundry washing machine. As used herein, the "horizontal axis" laundry washing machine refers to a laundry washing machine having a rotatable drum that rotates about a generally horizontal axis relative to a surface that supports the washing machine. However, the rotational axis need not be perfectly horizontal to the surface. The drum may rotate about an axis inclined relative to the horizontal axis, with fifteen degrees of inclination being one example of the inclination. Similar to the horizontal axis laundry washing machine, the horizontal axis washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. Other non-limiting examples of the laundry treating appliance 12 include a vertical axis laundry washing machine; a laundry dryer; a combination washing machine and dryer; a tumbling refreshing/revitalizing machine; an extractor; and a non-aqueous laundry system.

The laundry treating appliance 12 may include a cabinet 14, a door 16, and a controller 18. The cabinet 14 may be defined by a front wall 20, a rear wall 22, a pair of side walls 24, and a top wall 26. The door 16 may be hingedly connected to the front wall 20 of the cabinet 14 and may be configured to selectively move to provide access to a treating chamber 28. The cabinet 14 may include a rotatable drum 30 defining the treating chamber 28 and which may be located within a tub 32 for receiving laundry to be treated during a cycle of operation. The drum 30 may include a plurality of perforations 34 such that liquid may flow between the drum 30 and the tub 32 through the perforations 34. The drum 30 may further include a plurality of lifters 36 disposed on the inner surface of the drum 30 with predetermined gaps between the lifters 36 to lift the laundry load received in the treating chamber 28 while the drum 30 rotates.

While the illustrated washing machine 12 includes both the tub 32 and the drum 30, with the drum 30 defining the treating chamber 28, it is within the scope of the invention for the washing machine 12 to include only one receptacle, with the receptacle defining the treating chamber 28 for receiving the laundry load to be treated within the treating chamber 28.

Figure 2:
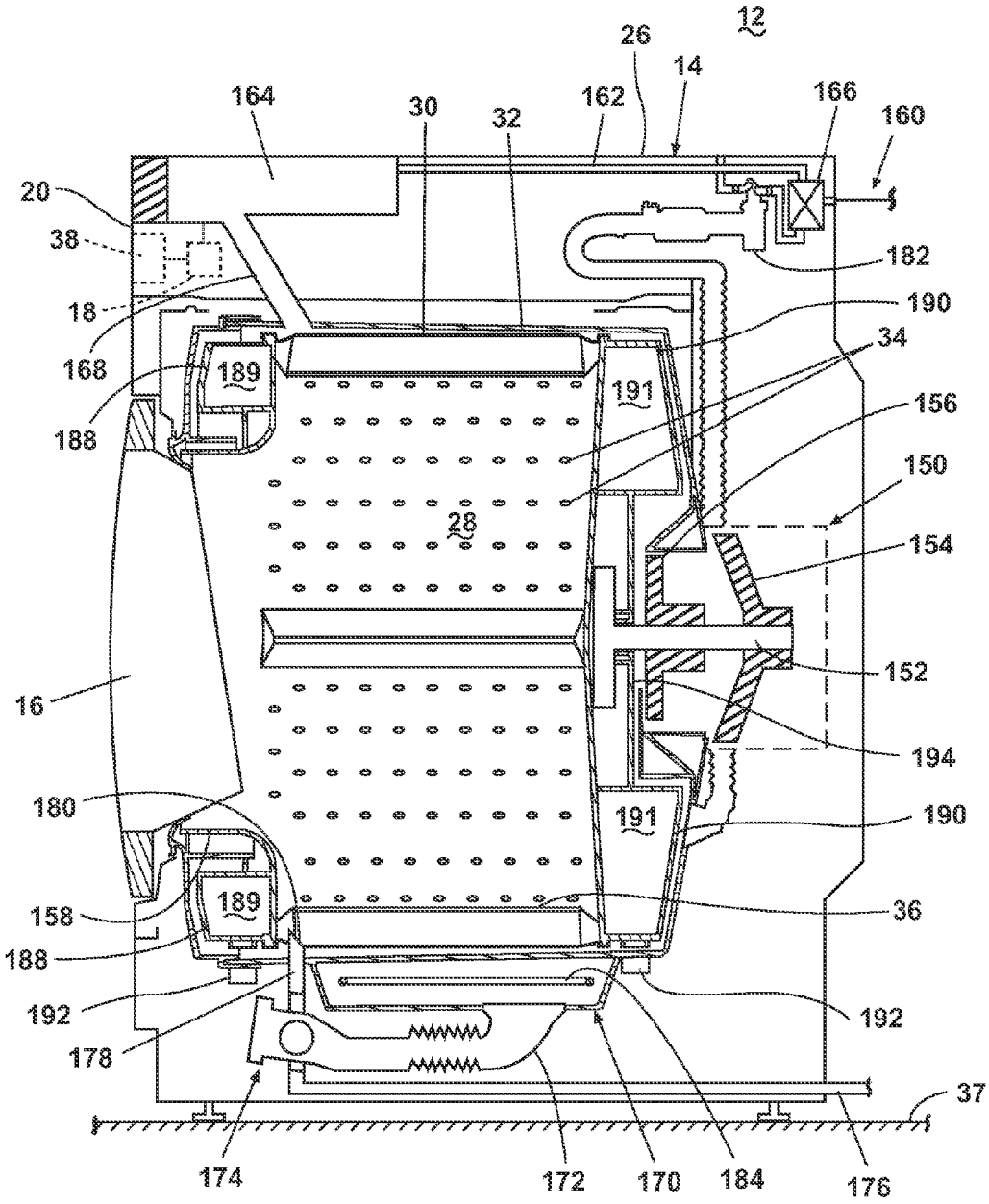
FIG. 2 is a schematic cross-sectional view of the laundry treating appliance from FIG. 1 resting on a floor.

FIG. 2 is a schematic cross-sectional view of the laundry treating appliance 12 resting on a floor 37. The drum 30 may be operably coupled with a motor 150 to selectively rotate the drum 30 during a cycle of operation according to the input from a user interface 38. The user interface 38 may be operably coupled to the controller 18 that may selectively operate a cycle of operation set by a user through the user interface 38. The controller 18 may further be operably coupled to one or other components of the washing machine 12 to selectively complete a cycle of operation.

The motor 150 may be directly coupled with a drive shaft 152 to rotate the drum 30. The motor 150 may be a brushless permanent magnet (BPM) motor having a stator 154 and a rotor 156. Alternately, the motor 150 may be coupled to the drum 30 through a belt and a drive shaft to rotate the drum 30, as is known in the art. Other motors, such as an induction motor or a permanent split capacitor (PSC) motor, may also be used. The motor 150 may rotate the drum 30 at various speeds in either rotational direction. A bellows 158 couples an open face of the tub 32 with the cabinet 14, and the door 16 seals against the bellows 158 when the door 16 closes the tub 32.

The laundry treating appliance 12 may further include a liquid supply and recirculation system. Liquid, such as water, may be supplied to the laundry treating appliance 12 from a water supply 160, such as a household water supply. A supply conduit 162 may fluidly couple the water supply 160 to the tub 32 and a treatment dispenser 164. The supply conduit 162 may be provided with an inlet valve 166 for controlling the flow of liquid from the water supply 160 through the supply conduit 162 to either the tub 32 or the treatment dispenser 164.

A liquid conduit 168 may fluidly couple the treatment dispenser 164 with the tub 32. The liquid conduit 168 may couple with the tub 32 at any suitable location on the tub 32 and is shown as being coupled to a top wall 26 of the tub 32 in FIG. 2 for exemplary purposes. The liquid that flows from the treatment dispenser 164 through the liquid conduit 168 to the tub 32 typically enters a space between the tub 32 and the drum 30 and may flow by gravity to a sump 170 formed in part by a lower portion of the tub 32. The sump 170 may also be formed by a sump conduit 172 that may fluidly couple the lower portion of the tub 32 to a pump 174. The pump 174 may direct fluid to a drain conduit 176, which may drain the liquid from the laundry treating appliance 12, or to a recirculation conduit 178, which may terminate at a recirculation inlet 180. The recirculation inlet 180 may direct the liquid from the recirculation conduit 178 into the drum 30. The recirculation inlet 180 may introduce the liquid into the drum 30 in any suitable manner, such as by spraying, dripping, or providing a steady flow of the liquid.

The liquid supply and recirculation system may further include one or more devices for heating the liquid such as a steam generator 182 or a sump heater 184. The steam generator 182 may be provided to supply steam to the treating chamber 28, either directly into the drum 30 or indirectly through the tub 32 as illustrated. The inlet valve 166 may also be used to control the supply of water to the steam generator 182. The steam generator 182 is illustrated as a flow through steam generator, but may be other types, including a tank type steam generator. Alternatively, the sump heater 184 may be used to generate steam in place of or in addition to the steam generator 182. The steam generator 182 may be controlled by the controller 18 and may be used to heat to the laundry as part of a cycle of operation, much in the same manner as the sump heater 184. The steam generator 182 may also be used to introduce steam to treat the laundry as compared to merely heating the laundry.

Additionally, the liquid supply and recirculation system may differ from the configuration shown in FIG. 2, such as by inclusion of other valves, conduits, wash aid dispensers, sensors, such as water level sensors and temperature sensors, and the like, to control the flow of liquid through the laundry treating appliance 12 and for the introduction of more than one type of detergent/wash aid. Further, the liquid supply and recirculation system need not include the recirculation portion of the system or may include other types of recirculation systems.

The laundry treating appliance 12 may further include an active balancing system, which may be used to reduce vibration and the resulting noise during a cycle of operation by ensuring that the laundry load is evenly distributed and the drum 30 is balanced when operating at rotational speeds equal to or greater than 150 rpm. The active balancing system may include at least one balancing ring 188, 190 that may be operably coupled to the drum 30. As illustrated, the active balancing system may have front and rear balancing rings 188, 190 that may be operably coupled to the front and rear ends of the drum 30, respectively. Each balancing ring 188, 190 may further include at least one chamber 189, 191, respectively, into which balancing material may be introduced. As shown, each balancing ring 188, 190 includes multiple chambers, with only chambers 189, 191 of each balancing ring 188, 190 visible in FIG. 2.

The balancing material may be any appropriate material in the form of solid, liquid or mixture thereof that may be supplied to the chambers 189, 191 of the balancing rings 188, 190 to counterbalance any potential imbalance during a cycle of operation of the laundry treating appliance 12. Liquid from the liquid supply and recirculation system may be used as the balancing material. As such, the active balancing system may be fluidly coupled with the liquid supply and recirculation system. The front and rear balancing rings 188, 190 may each receive liquid from a feeder 194, which may be fluidly coupled to the water supply 160, although the coupling is not illustrated herein. Alternatively, the front balancing ring 188 may be fluidly coupled to the rear balancing ring 190 through the lifters 36 to receive liquid indirectly via the rear balancing ring 190 that may be fluidly coupled to the feeder 194.

The active balancing system may further include at least one sensor 192 for detecting out of balance and/or balanced parameters of the laundry treating appliance 12 during a cycle of operation, as will be described in more detail below. The at least one sensor 192 may be coupled between the tub 32 and the cabinet 14, and may be a load cell or an accelerometer. As illustrated, multiple sensors 192 are provided.

Figure 3:
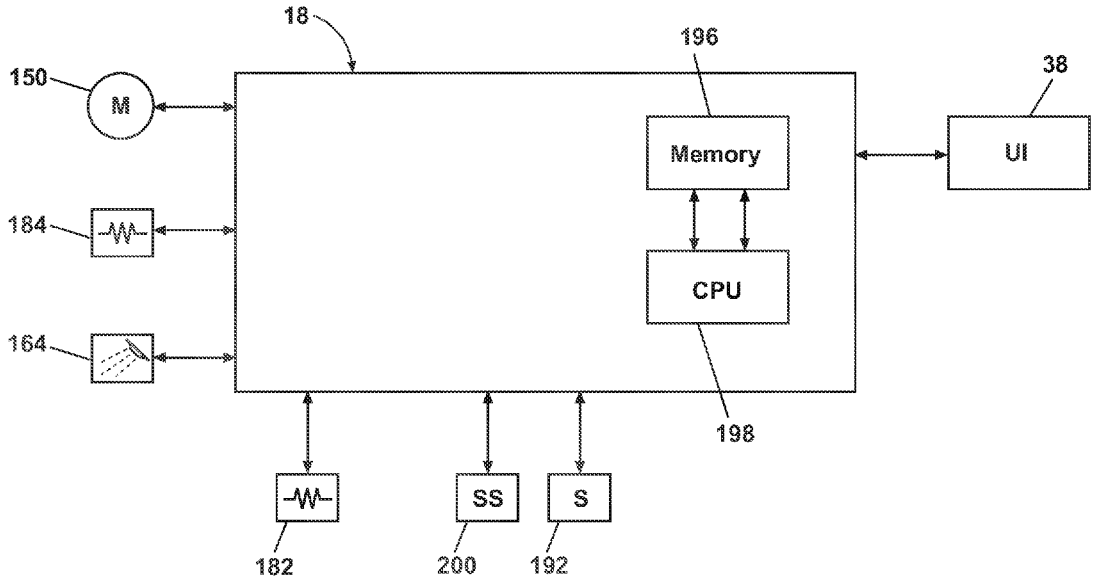
FIG. 3 is a schematic representation of a controller for controlling the operation of one or more components of the laundry treating appliance of FIG. 1.

FIG. 3 is a schematic representation of the controller 18 of the laundry treating appliance 12. As illustrated, the controller 18 may be provided with a memory 196 and a central processing unit (CPU) 198. The memory 196 may be used for storing the adjustment algorithm that is executed by the CPU 198 in completing a cycle of operation for the laundry treating appliance 12 and any additional software. The memory 196 may also be used to store information, such as a database or a look-up table, and to store data received from one or more components of the laundry treating appliance 12 that may be communicably coupled with the controller 18.

The controller 18 may be operably coupled with one or more components of the laundry treating appliance 12 for communicating with and controlling the operation of the component to complete a cycle of operation. For example, the controller 18 may be coupled with the user interface 38 for receiving user selected inputs and communicating information with the user, the motor 150 for controlling the direction and speed of rotation of the drum 30, and the treatment dispenser 164 for dispensing a treating chemistry during a cycle of operation. The controller 18 may be coupled to the steam generator 182 and the sump heater 184 to heat the liquid as required by the controller 18. The controller 118 may also be coupled to the sensors 192 to receive input used to control the active balancing system. The controller 18 may also receive input from one or more additional sensors 200, non-limiting examples of which include: a treating chamber temperature sensor, a weight sensor, a turbidity sensor, a conductivity sensor, a position sensor, and a motor torque sensor.

The previously described laundry treating appliance 12 provides the structure necessary for the implementation of the method of the invention. One embodiment of the method of the invention will now be described in terms of the operation of the laundry treating appliance 12. The method of the invention functions to determine a floor parameter of the floor 37 and may set at least one operating parameter of the laundry treating appliance 10 based on the determined floor parameter.

Figure 4:
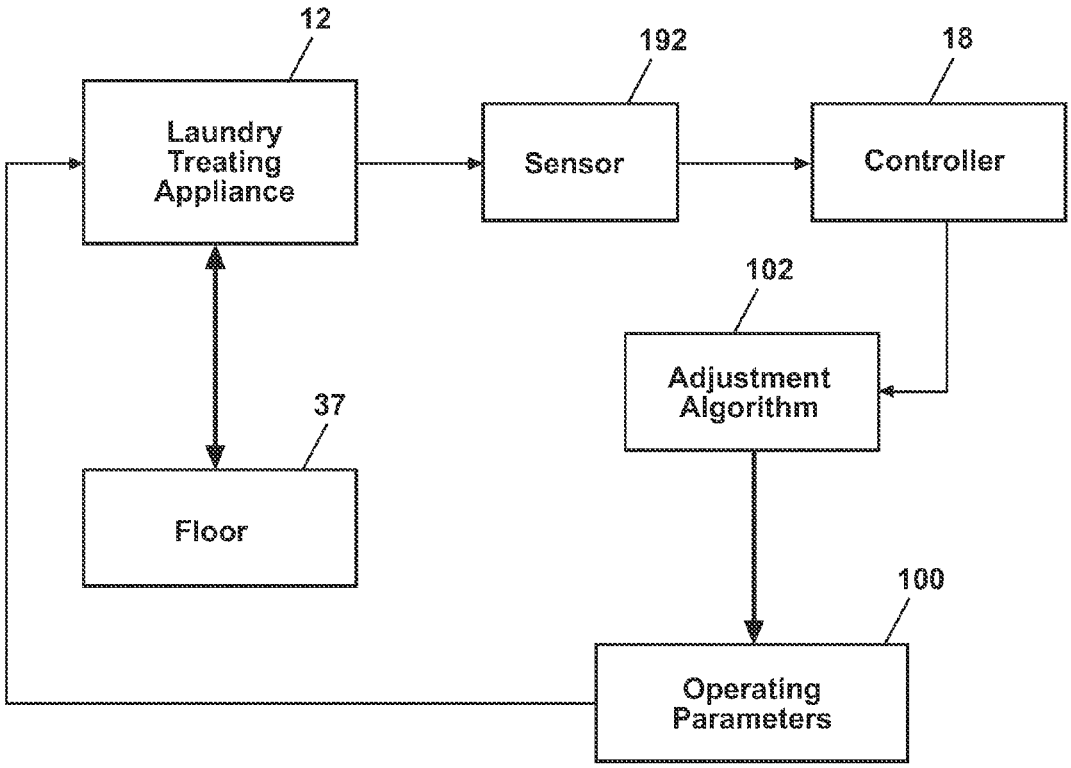
FIG. 4 is a block diagram for illustrating a structure for setting at least an operating parameter of the laundry treating appliance of FIG. 1.

FIG. 4 illustrates a block diagram illustrating a structure for setting at least one operating parameter 100 of the laundry treating appliance 12 resting on the floor 37. The sensors 192 may be used to detect an out of balance parameter and/or a balanced parameter of the laundry treating appliance 12. The out of balance parameter may be a parameter detected by the sensors 192 when the drum 30 is out of balance, i.e. the drum 30 contains an imbalance, such as that created by an unevenly distributed load of laundry. As will be described in more detail below, in accordance with the present invention, an artificial imbalance may also be created in the drum 30 using the active balancing system, whereby the balancing rings 188, 190 are filled with balancing material to deliberately create a known or reference out of balance condition in the laundry treating appliance 12. The balanced parameter may be a parameter detected by the sensors 192 when the drum 30 is balanced, i.e. the drum does not contain an imbalance, such as when the drum 30 is empty, when the load of laundry is evenly distributed or when the active balancing system works to balance the drum 30. The out of balance and/or balanced parameters may include: (1) a gravitational force on the tub 32; and/or (2) a displacement of the laundry treating appliance 12 in the front-to-back or side-to-side direction.

The sensor 192 may communicate the out of balance and balanced parameters to the controller 18, which may store reference data relating to the out of balance and balanced parameters in the memory 196 or any other storage device operably coupled with the controller 18. Specifically, the reference data may include the look-up table of floor parameters and corresponding out of balance and balanced parameters. The floor parameter may include a material of the floor 37, a behavior of the floor 37, and/or a mechanical property of the floor 37. Examples of floor materials include, but are not limited to carpet, wood, polyurethane, linoleum, ceramic tile, or concrete. Examples of floor behaviors include, but are not limited to vertical deflection, vibration, hardness, or strength. Examples of mechanical properties include, but are not limited to elasticity, plasticity, ductility, toughness, strength, or Poisson's ratio.

Using an adjustment algorithm 102 implemented by any other appropriate control software that may be stored in the memory 196, central processing unit (CPU) 198, or any other storage device operably coupled with controller 18, the out of balance and balanced parameters may be compared with the reference data to select one or more floor parameters that may most closely match the out of balance and balanced parameters obtained when the drum is out of balanced and balanced, respectively. After selecting the most closely matching floor parameter(s), the adjustment algorithm 102 may select, modify, or revise one or more operating parameter(s) 100 of the laundry treating appliance 12. The operating parameter(s) 100 may include a speed profile, a rotational speed of the drum 30, an operating time of the drum 30, and/or a maximum rotational speed of the drum 30 during a cycle of operation. The speed profile may include both the rotational speed and the operating time of the drum 30 during each phase of the cycle of operation. The operating parameters 100 may be communicated to the user via the user interface 38 to provide the user with any information about the cycle of operation. For example, a natural frequency of the combined system of washer and floor may vary by the floor type. Therefore, the speed or the range of speed(s) at which adjustment takes place may change depending on the floor type.

Figure 5:
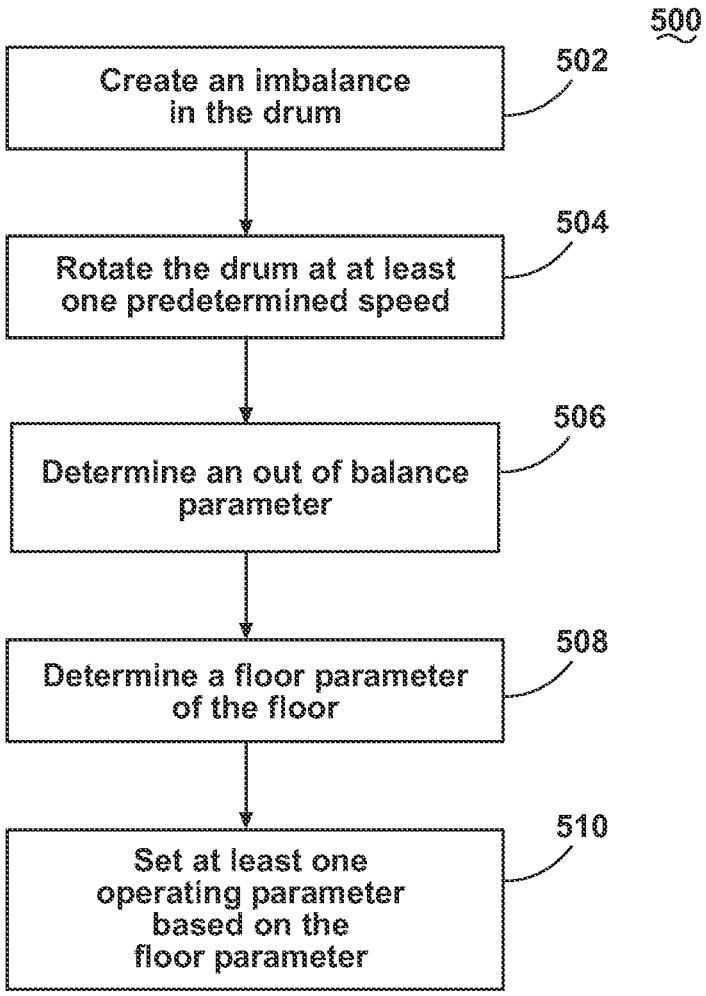
FIG. 5 is a flow chart illustrating a method for adjusting an operating parameter of the laundry treating appliance of FIG. 1.

FIG. 5 is a flow chart illustrating a method 500 that can employ the above structure for adjusting an operating parameter of the laundry treating appliance 12. The sequence of steps depicted is for illustrative purposes only and is not meant to limit the method 500 in any way as it is understood that the steps may proceed in a different logical order, additional or intervening steps may be included, or described steps may be divided into multiple steps, without detracting from the invention. The method 500 may be incorporated into a treating cycle of the laundry treating appliance 12, such as prior to the beginning of a first treating phase, for example a wash phase, or may be performed independently from a treating cycle. It is noted that the method 500 may be used only without laundry placed within the drum 30. The method 500 may be carried out by the controller 18.

The method 500 may begin at 502 with the creation of an imbalance in the drum 30. To create the imbalance, balancing material, such as liquid, can be added to the drum 30. Specifically, liquid may be initially added to the active balancing system to create the imbalance. The controller 18 may control the supply of liquid to the active balancing system such that a predetermined amount of liquid may be initially added to one or more preselected chamber(s) 189, 191 of the balancing rings 188, 190. In this way, the imbalance in the drum 30 may be predetermined, and can be reliably recreated during multiple cycles of the method 500.

At 504, the drum 30 may be rotated at least one predetermined speed. In the laundry treating appliance 12 of FIGS. 1-2, the motor 150 may drive the rotation of the drum 30. Rotating the drum 30 with the imbalance created at 502 deliberately creates an artificial out of balance condition in the laundry treating appliance 12. Since both the imbalance in the drum 30 and the rotational speed of the drum 30 may be predetermined, the out of balance condition may be considered to be a predetermined condition as well. The drum 30 may be rotated for a predetermined time at 504, or may be rotated for a time sufficient to determine an out of balance parameter of the out of balance condition, as will be explained below for step 506.

The predetermined speed at 504 may be a speed or a range of speeds that is sufficient to excite the natural frequency of the laundry treating appliance 12. Operating the laundry treating appliance 12 at or near a natural frequency may result in a large resonant vibration response by the laundry treating appliance 12. It is noted that exciting the natural frequency of the laundry treating appliance 12 does not require operating the laundry treating appliance 12 exactly at the natural frequency; rather, the laundry treating appliance 12 may be operating close enough to the natural frequency that the effect of increasing the vibration response starts to be seen.

It is contemplated that the order for 502 and 504 may be reversed in implementing the method 500. For example, the drum 30 may rotate at a predetermined speed after any imbalance in the drum 30 is created, while the drum 30 may rotate at a predetermined speed before any imbalance in the drum 30 is created.

At 506, one or more out of balance parameters may be determined for the out of balance condition created in step 504. The sensors 192 of the laundry treating appliance 12 (FIG. 2) may detect the out of balance parameter, which, as discussed above, may include: (1) a gravitational force on the tub 32, and/or; (2) a displacement of the laundry treating appliance 12 in the front-to-back or side-to-side direction. Although only one out of balance parameter may be determined at 506, in another embodiment, a plurality of out of balance parameters may be determined for the out of balance condition created at 504. The sensor 192 may communicate the out of balance parameter to the controller 18.

At 508, a floor parameter of the floor 37 is determined from the out of balance parameter(s) determined at 506. To determine the floor parameter, examples of which are given above, the out of balance parameter(s) determined at 506 may be communicated to the adjustment algorithm 102 stored in the controller 18. The adjustment algorithm 102 may compare the out of balance parameter(s) with any appropriate reference data, including the look-up table of floor parameters and corresponding out of balance and balanced parameters stored in the memory 196 or CPU 198 of the controller 18 to determine the floor parameter.

At 510, at least one operating parameter 100 of the laundry treating appliance 12 may be set based on the floor parameter determined at 508. Any appropriate adjustment algorithm 102 may change or modify the operating parameters 100 of the laundry treating appliance 12 such that the operating parameters 100 of the laundry treating appliance 12 correspond to the floor parameter determined at 508. As described in FIG. 4, examples of operating parameters 100 may include a speed profile, a rotational speed of the drum 30, an operating time of the drum 30, and/or a maximum rotational speed of the drum 30 during a cycle of operation. Since vibration and noise may vary according to the floor 37 on which the laundry treating appliance 12 rests, the operating parameters 100 may be optimized to minimize vibration and noise during the cycle of operation.

As illustrated, only one cycle through each step of the method 500 may be required to set the operating parameter(s) 100. Alternatively, one or more steps of the method 500 may be repeated. For example, steps 504 and 506 may be iterated multiple times to determine one or more floor parameter(s) 100 of the floor 37. In another alternative embodiment, at 504, the drum 30 may be rotated at multiple different predetermined speeds. In this case, at least one out of balance parameter can be determined at each speed at 506. From the multiple out of balance parameters, one or more floor parameters can be determined at 508. Using multiple out of balance parameters may result in a more accurate determination of the floor parameter at 508 since different floors 37 may have some overlapping characteristics.

Figure 6:
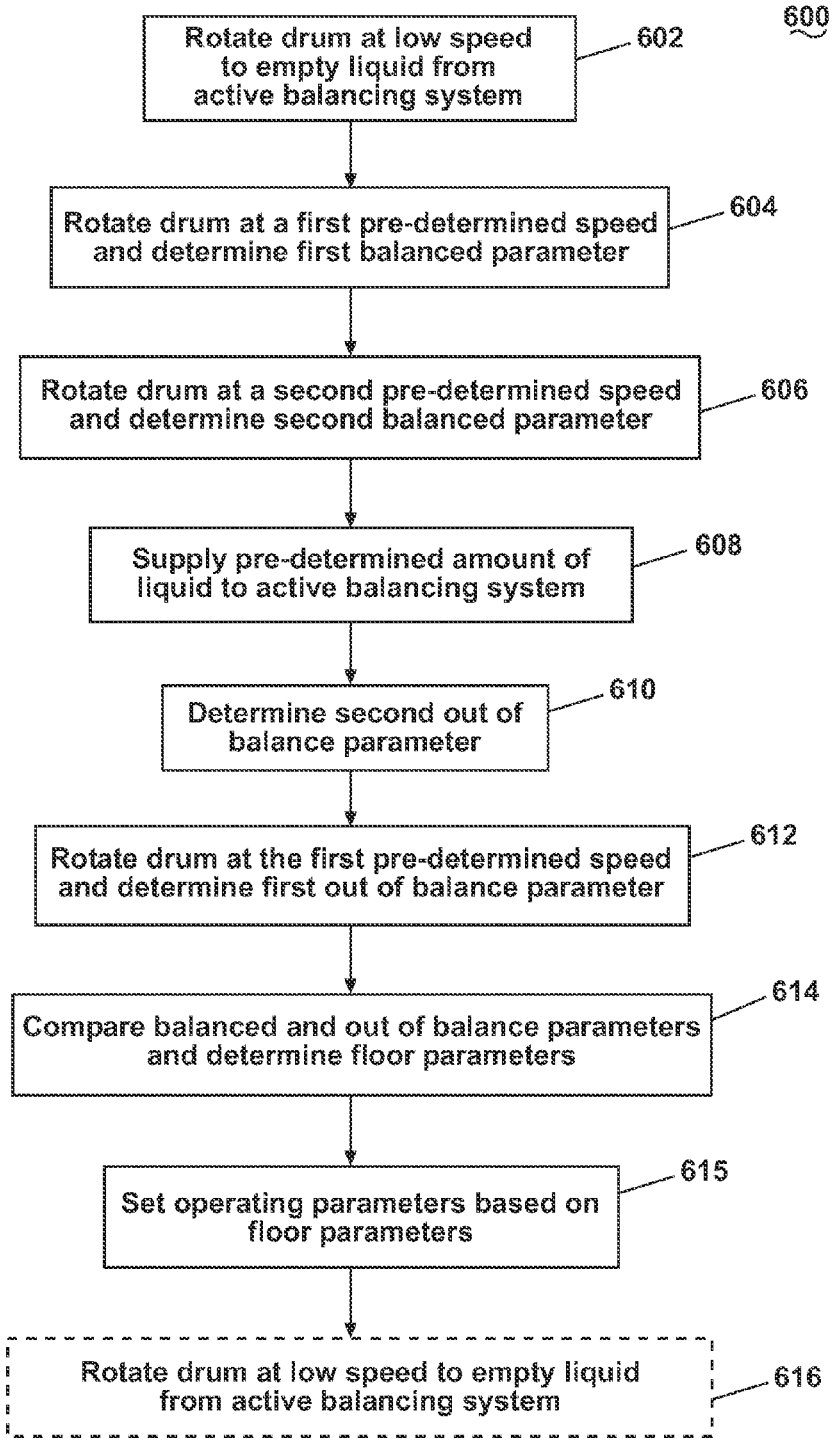
FIG. 6 is a flow chart illustrating another method for adjusting an operating parameter of the laundry treating appliance of FIG. 1.

FIG. 6 is a flow chart illustrating another method 600 for adjusting an operating parameter 100 of the laundry treating appliance 12. The sequence of steps depicted is for illustrative purposes only and is not meant to limit the method 600 in any way as it is understood that the steps may proceed in a different logical order, additional or intervening steps may be included, or described steps may be divided into multiple steps, without detracting from the invention. The method 600 may be incorporated into a treating cycle of the laundry treating appliance 12, such as prior to the beginning of a first treating phase, for example, a wash phase, or may be performed independently from a treating cycle. It is noted that the method 600 may be used only without laundry placed within the drum 30, and that it will be described in terms of the treating chamber 28 being empty. The method 600 may be carried out by the controller 18.

The method 600 may start at 602 by rotating the drum 30 at speed equal to or less than 20 rpm to empty liquid from the active balancing system. Depending on the configuration of the balancing rings 188, 190 and the feeder 194, liquid drained from the chambers 189, 191 may be collected in the sump 170 for future use or may be drained out of the laundry treating appliance 12 via the drain conduit 176. This ensures that the drum 30 is balanced. This also ensures that any liquid subsequently added to the active balancing system to create an imbalance in the drum 30 will be the only liquid in the active balancing system; in this way, the out of balance condition created subsequently can be controlled.

At 604, the balanced drum 30 may be rotated at a first predetermined speed and a first balanced parameter may be determined. Rotating the balanced drum 30 creates a balanced condition in the laundry treating appliance 12. Since both the balance in the drum 30 and the rotational speed of the drum 30 may be predetermined, the balanced condition may be considered to be a predetermined condition as well. The first balanced parameter may be measured and determined using the sensor 192. The sensor 192 may communicate the first balanced parameter to the controller 18. The drum 30 may be rotated for a predetermined time at 604, or may be rotated for a time sufficient to determine the first balance parameter for the balanced condition.

At 606, the balanced drum 30 may be rotated at a second predetermined speed and a second balanced parameter may be determined. The second predetermined speed may be different from the first predetermined speed. This creates a different balanced condition in the drum 30. In one example, the second predetermined speed may be greater than the first predetermined speed. Similar to 604, the second balanced parameter may be measured and determined using the sensor 192, and the sensor 192 may communicate the second balanced parameter to the controller 18. The drum 30 may be rotated for a predetermined time at 606, or may be rotated for a time sufficient to determine the second balance parameter for the balanced condition.

As illustrated in FIG. 6, two predetermined balanced conditions may be used to determine two balanced parameters; however, in other embodiments only one balanced condition may be created to determine one balanced parameter, or more than two balanced conditions may be used to determine more than two balanced parameters. It is noted that rotating the drum 30 at a predetermined speed in the method 600 may include rotating the drum 30 at the speed or the range of speeds that may be sufficient to excite a natural frequency of the laundry treating appliance 12.

At 608, an imbalance can be created in the drum by supplying a predetermined amount of liquid to the active balancing system. Specifically, the liquid may be introduced into preselected chambers 189, 191 in the balancing rings 188, 190. This may be done while the drum 30 is rotating at the second predetermined speed to create an out of balance condition. At 610, with the unbalanced drum 30 rotating at the second predetermined speed, a second out of balance parameter may be determined in a similar manner as the balanced parameters were determined. The drum 30 may be rotated for a predetermined time at 610, or may be rotated for a time sufficient to determine the second out of balance parameter for the out of balance condition.

At 612, the unbalanced drum 30 may be rotated at the first predetermined speed and a first out of balance parameter may be determined in a similar manner as the balanced parameters were determined. The drum 30 may be rotated for a predetermined time at 612, or may be rotated for a time sufficient to determine the first out of balance parameter for the out of balance condition. While the first and second predetermined speeds at 612 and 610 are illustrated as being identical to the first and second predetermined speed at 604 and 606, in another embodiment, the range of the first and second predetermined speeds at 612 and 610 may overlap with the range of the first and second predetermined speeds at 604 and 606.

At 614, the first and second balanced parameters and the first and second out of balance parameters determined in the previous steps may be compared with the reference data or look-up table described above, using the adjustment algorithm 102 shown in FIG. 4, to determine one or more floor parameters. At 615, one or more operating parameters 100 may be selected based on the floor parameter(s) from 614, in a similar manner as step 510 from method 500.

Optionally, at 616, the drum 30 may rotate at a low speed to empty liquid from the active balancing system. This provides a balanced drum 30 for the start of a subsequent cycle of operation. When all liquid is emptied from the active balancing system, the drum 30 may stop rotating.

It is noted that while the balanced and out of balance parameters may be used to determine the characteristics of the floor 37 in method 600, in another embodiment, only the out of balance parameters may be used to determine the characteristics of the floor 37. It is also noted that one or more steps of the method 600 may be repeated. For example, the steps may be iterated multiple times to determine one or more floor parameter(s) of the floor 37. In the case of multiple iterations, the balanced and out of balance parameters measured multiple times may be mathematically processed using the adjustment algorithm or other control software to represent the floor parameters.

The invention described herein provides a method for setting an operating parameter of a laundry treating appliance based on a parameter of the floor on which the laundry treating appliance rests. The method of the invention can advantageously be used when the laundry treating appliance is moved to rest on a different floor, such as when moving the laundry treating appliance from a manufacturing site to a home, between homes, or between rooms having different floors. By setting certain operating parameters based on the floor on which the laundry treating appliance rests during operation, vibration and/or noise generated during a cycle of operation can be minimized. The methods of the invention may employ the existing active balancing system of the laundry treating appliance, which does not require the addition of any complex or expensive components to the laundry treating appliance.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of controlling an operation of a laundry treating appliance resting on a floor and having a rotatable drum defining a treating chamber, the method comprising:

creating an imbalance in the drum;

rotating the drum at at least one predetermined speed;

determining an out of balance parameter for an out of balance condition created by the rotation of the drum with the imbalance;

determining a floor parameter of the floor based on the out of balance parameter; and setting at least one operating parameter based on the floor parameter.

2. The method of claim 1 wherein the creating the imbalance comprises adding balancing material to the drum.

3. The method of claim 2 wherein the adding balancing material to the drum comprises adding liquid to an active balancing system for the drum.

4. The method of claim 3 wherein the adding liquid comprises adding a predetermined amount of liquid to the active balancing system to create a predetermined imbalance.

5. The method of claim 3 wherein the adding liquid comprises adding liquid to at least one chamber of a multiple chamber balancing ring of the active balancing system.

6. The method of claim 5 wherein the adding liquid comprises adding liquid to multiple preselected chambers of the multiple chamber balancing ring.

7. The method of claim 3 wherein the rotating the drum comprises rotating the drum at a speed equal to or less than 20 rpm sufficient to empty any liquid from the active balancing system.

8. The method of claim 1 wherein the rotating the drum comprises rotating the drum at a speed to excite a natural frequency of the laundry treating appliance.

9. The method of claim 1 wherein the laundry treating appliance further comprises a tub for receiving the drum and the out of balance parameter comprises at least one of a gravitational force on the tub and a displacement of the laundry treating appliance.

10. The method of claim 1 wherein the rotating the drum comprises rotating the drum at multiple predetermined speeds.

11. The method of claim 10 wherein the determining the out of balance parameter comprises determining the out of balance parameter at each of the multiple predetermined speeds.

12. The method of claim 11 wherein the determining the floor parameter further comprises comparing the multiple out of balance parameters to reference data.

13. The method of claim 12 wherein the reference data comprises a look-up table of floor parameters and corresponding out of balance parameters, and wherein determining the floor parameter further comprises selecting the floor parameter from the look-up table having corresponding out of balance parameters that most closely matches the multiple out of balance parameters determined for the out of balance condition.

14. The method of claim 1, further comprising rotating the drum at the predetermined speed without the imbalance in the drum.

15. The method of claim 14, further comprising determining a balanced parameter for a balanced condition created by the rotation of the drum without the imbalance.

16. The method of claim 15 wherein the determining the floor parameter is further based on the balanced parameter.

17. The method of claim 16 wherein the rotating the drum at the predetermined speed without the imbalance in the drum comprises rotating the drum at multiple predetermined speeds without the imbalance in the drum.

18. The method of claim 17 wherein the determining the balanced parameter comprises determining the balanced parameter for the balanced condition at each of the multiple predetermined speeds.

19. The method of claim 1 wherein the determining the floor parameter further comprises comparing the out of balance parameter to reference data.

20. The method of claim 19 wherein the reference data comprises a look-up table of floor parameters and corresponding out of balance parameters, and wherein determining the floor parameter further comprises selecting the floor parameter from the look-up table having a corresponding out of balance parameter that most closely matches the out of balance parameter determined for the out of balance condition.

21. The method of claim 20 wherein the setting the at least one operating parameter comprises setting at least one of a speed profile and a maximum rotational speed for the drum based on the floor parameter selected from the look-up table.

22. The method of claim 1 wherein the floor parameter comprises at least one of a material of the floor, a behavior of the floor, and a mechanical property of the floor.

23. The method of claim 1 wherein the setting the at least one operating parameter comprises setting at least one of a speed profile for the drum and a maximum rotational speed of the drum.

* * * * *